US009010004B1

(12) United States Patent
Fu

(10) Patent No.: US 9,010,004 B1
(45) Date of Patent: Apr. 21, 2015

(54) SYSTEMS AND METHODS FOR LOCKING AND RELEASING DETACHABLE FIREARM MAGAZINES

(71) Applicant: Peter Fu, La Habra, CA (US)

(72) Inventor: Peter Fu, La Habra, CA (US)

( * ) Notice: Subject to any disclaimer, the term of this patent is extended or adjusted under 35 U.S.C. 154(b) by 0 days.

(21) Appl. No.: 14/097,466

(22) Filed: Dec. 5, 2013

(51) Int. Cl.
*F41A 9/59* (2006.01)
*F41A 17/38* (2006.01)

(52) U.S. Cl.
CPC ..... *F41A 17/38* (2013.01)

(58) Field of Classification Search
CPC ..... F41A 9/59; F41A 3/66; F41A 35/06; F41A 5/18; F41A 17/38
USPC ..... 42/6, 7, 49.01, 50; 89/33.01, 33.1
See application file for complete search history.

(56) References Cited

U.S. PATENT DOCUMENTS

| | | | | |
|---|---|---|---|---|
| 4,768,301 | A * | 9/1988 | Thomas | 42/7 |
| 5,519,954 | A * | 5/1996 | Garrett | 42/6 |
| 8,112,926 | B2 * | 2/2012 | Gussalli Beretta | 42/7 |
| 2006/0096145 | A1 * | 5/2006 | Gussalli Beretta | 42/50 |
| 2006/0123683 | A1 * | 6/2006 | Garrett et al. | 42/6 |
| 2014/0165439 | A1 * | 6/2014 | Fernandez et al. | 42/6 |
| 2014/0317980 | A1 * | 10/2014 | Michel | 42/6 |

* cited by examiner

*Primary Examiner* — Bret Hayes
*Assistant Examiner* — Derrick Morgan
(74) *Attorney, Agent, or Firm* — Alexander Chen, Esq.

(57) ABSTRACT

An apparatus for releasing firearm magazine comprising an outer button, an inner button, a first spring and a securing plate wherein the inner button and the first spring is located within the outer button by the securing plate a lower receiver of a rifle a second spring and a magazine catch wherein the magazine catch is comprised of a shaft and a threaded portion wherein the second spring is positioned over the shaft and is further posited inside the lower receiver the threaded portion is functionally engaged to the inner button such that the inner button can be adjusted along the length of the threaded portion the outer button further comprising a stopping device along the perimeter of the outer button wherein the stopping device prevents the movement of the outer button towards the lower receiver.

6 Claims, 7 Drawing Sheets

SYSTEMS AND METHODS FOR LOCKING AND RELEASING DETACHABLE FIREARM MAGAZINES

CROSS-REFERENCE TO RELATED APPLICATION

This application claims priority to U.S. Provisional Patent Application, Systems and Methods for Locking and Releasing Detachable Firearm Magazines, No. 61/857,224, filed Jul. 22, 2013, which are herein incorporated by reference in their entirety.

FIELD OF THE INVENTION

The present invention relates to semi-automatic firearms of the well known and popular AR-15 rifle type, and more specifically to the mandated-statute from magazine release. In particular, this invention addresses the magazine-clip release-button mechanism that works as a regular magazine release, a fixed magazine release (Bullet Button™), or to lock out the button completely.

BACKGROUND OF THE INVENTION

Different types of firearms and firearm accessories have increased steadily over time in both functionality and flexibility, and today, there is a wide variety of firearms and accessories available. Innovation in the firearms industry is also driven by legislative trends, as firearm owners are required to respond by limiting the functionality of their firearms and/or accessories.

In recent times, Federal and/or State laws have limited features of semi-automatic firearms and/or also the capacity of firearm magazines. In some jurisdictions, the use of detachable magazines with semi-automatic rifles is strictly regulated. For example, in 1989, the Roberti-Roos Assault-weapons Control-act was passed in California, mandating the encumbering of the original quick-release button be retrofitted into what is legislatively referred to as a "fixed-magazine" release-button. This necessitated the use of an encumbering supplemental-tool which by legislative mandate cannot be an inherently permanent part of the rifle.

To comply, the magazine release mechanism of these semi-automatic rifles has to be modified to work only with a tool such as the bullet tip of a rifle cartridge. Systems and methods of modifying these semi-automatic rifles have been achieved by design changes by gun parts manufacturers. One of the most common modifications is a Bullet Button™, which modifies a rifle to prevent the user from being able to release a magazine by solely using a finger. Weapons with this feature no longer have a "detachable magazine" within the assault weapons definition, and therefore may be exempt depending on the other requirements.

Specifically, the AR-15 rifle was originally designed and manufactured as a fully-automatic firing gun, however, some States impose modifications mandating conversion-restriction into only semi-automatic operation. For example, California requires a separate tool-release of a maximum 10-round magazine-clip.

Accordingly, prior arts have included the well-known impeding release-button device that is also known as the Bullet Button™. The Bullet Button™ is a product that allows the shooter to drop a magazine with the use of a tool. It prevents finger manipulation of the magazine release, and creates a condition allowable under the current laws of many jurisdictions. The assembly does not create a detachable magazine situation, but creates an attachable-fixed magazine condition. A bullet tip can be used as the tool, as can a number of other small objects such as an Allen wrench or a small screwdriver.

Other prior arts include a finger-tip device facilitating more convenient release of an magazine-clip from a gun, where the magazine/release-buttons of the gun are configured with a statute-mandated recessed sub-button, such as the Bullet Button™ discussed above. Such finger-tip device involves a rifle ammunition magazine-clip button depressor that employs index-finger finger-stall member to be adapted with a rigid probe insertion-pin necessarily made to fit into the center-bore of the existing specialty impeding release-button device.

These modifications results in ergonomic encumbrances to the users of these guns during firing-range practices. It may also pose as adversely imperiling the safe operation of the gun by distracting the shooter's attention from down-range concentration. This detrimental effect occurs when the shooter has spent the last round of their gun's magazine-clip, and is thus caused to fumble for a separate pocket-tool (such as the head of a bullet), which is necessary to insert into the release-hole, as mandate by some jurisdictions, to thereby facilitate a linear depression actuation of a sub-button recessed therein. This intentionally impeding release-button device actually retrofits and replaces the original quick-action magazine-clip release-button located upon the right sidewall of the gun's breech.

It has now become necessary, as statutes may mandate the ban of the use of Bullet Button™, to use a firearm button magazine release tool assembly that works as a regular magazine release, a fixed magazine release (Bullet Button™), or to lock out the button completely.

OBJECTIVE OF THE INVENTION

Accordingly, it is an object of this invention to provide a supplemental rifle ammunition magazine-clip method and system for locking and releasing detachable firearm magazines.

It is also an object of this invention to provide a firearm button magazine release tool assembly that works as a regular magazine release.

It is also an object of this invention to provide a firearm button magazine release tool assembly that works as a fixed magazine release, which functions similarly to the commonly used and widely known Bullet Button™.

It is also an object of this invention to provide a firearm button magazine release tool assembly that works to lock out the button completely to prevent the magazine from being release from the firearm.

It is also an object of this invention to provide a firearm button magazine release tool assembly that can be easily and quickly altered to work as regular magazine release, fixed magazine release, and to lock out the button completely.

It is also an object of this invention to provide a firearm button magazine release tool assembly that can be easily adaptable and fitted to standard rifles and effectively alter the firearm to comply with mandated-statute regarding magazine release in various jurisdictions.

It is also an object of this invention to provide a firearm button magazine release tool assembly with a double spring system that allows the button to work as a regular magazine release and as a fixed magazine release.

It is also an object of this invention to provide a firearm button magazine release tool assembly with a side locking screw that allows the button to be locked out completely.

It is also an object of this invention to provide a firearm button magazine release tool assembly to facilitate a more efficient time- and motion operation of the magazine release.

It is also an object of this invention to provide a firearm button magazine release tool assembly that can be altered to comply with multiple jurisdiction mandated-statute and make traveling to these various jurisdictions less troublesome.

It is also an object of this invention to provide a firearm button magazine release tool assembly that replaces and serves as regular magazine release, fixed magazine release, and a magazine button lock, thus preventing the need to purchase and carry multiple parts when traveling across various jurisdictions with different mandated-statute regarding magazine-release.

It is also an object of this invention to provide a firearm button magazine release tool assembly that the magazine-clip release-button mechanism tool assembly further does not impede and prevent the firearm or the magazine from its intended working in any way.

SUMMARY OF THE INVENTION

In one aspect, an apparatus for releasing firearm magazine is disclosed comprising an outer button, an inner button, a first spring and a securing plate wherein the inner button and the first spring is located within the outer button by the securing plate; a lower receiver of a rifle; a second spring and a magazine catch wherein the magazine catch is comprised of a shaft and a threaded portion wherein the second spring is positioned over the shaft and is further posited inside the lower receiver; the threaded portion is functionally engaged to the inner button such that the inner button can be adjusted along the length of the threaded portion; the outer button further comprising a stopping device along the perimeter of the outer button wherein the stopping device prevents the movement of the outer button towards the lower receiver. In one embodiment, the stopping device is comprised of one or more tabs. In one embodiment, the stopping device is comprised of a skirt along the perimeter of the outer button. In one embodiment, the stopping device is comprised of a skirt along the perimeter of the outer button. In one embodiment, the first spring and the second spring are compression springs. In one embodiment, the first spring and the second spring have the same spring rate.

In another aspect of the invention, an apparatus for releasing firearm magazine is disclosed comprising an outer button, an inner button, a first spring and a securing plate wherein the inner button and the first spring is located within the outer button by the securing plate; a lower receiver of a rifle; a second spring and a magazine catch wherein the magazine catch is comprised of a shaft and a threaded portion wherein the second spring is positioned over the shaft and is further posited inside the lower receiver; the threaded portion is functionally engaged to the inner button such that the inner button can be adjusted along the length of the threaded portion; the outer button further comprising a stopping device along the perimeter of the outer button wherein the stopping device prevents the movement of the outer button towards the lower receiver; the outer button further comprises a securing device wherein the securing device functions to secure the inner button to the outer button and to prevent the inner button to move independently against the outer button.

DETAIL DESCRIPTION OF THE INVENTION

Figure 1:
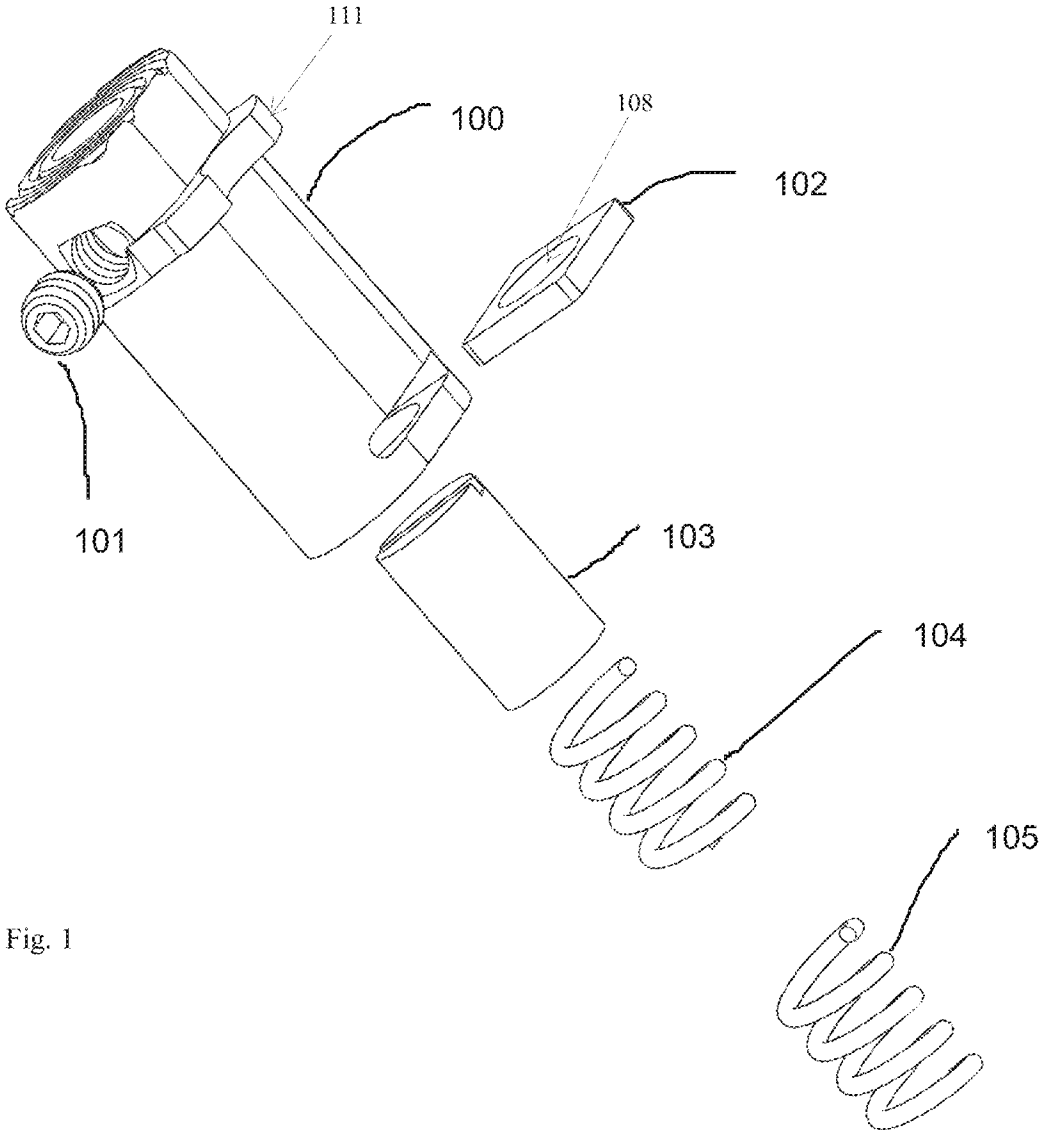
FIG. 1 is a exploded view of a firearm button magazine release tool assembly.

In view of the foregoing discussion about the earlier invention art, it is therefore important to make it pellucid to others interested in the art, that the object of this invention is to provide a supplemental firearm magazine-clip button-depressor means. Specifically, the present invention provides a firearm button magazine release tool assembly that works as a regular magazine release, a fixed magazine release (Bullet Button™), or to lock out the button completely.

The firearm button magazine release tool assembly can be easily and efficiently retrofitted into a standard rifle without any irreversible modification. Upon such installation, the rifle will be retrofitted will the firearm button magazine release tool assembly that will function differently depending on its setting.

In one embodiment, a firearm magazine includes a magazine body and a magazine release tool assembly. The tool assembly is configured to replace or modify the magazine release button so as to make the magazine in compliance with mandated-statutes.

In one setting, the magazine-clip release will work as a regular magazine-clip release. That is, without the use of additional or supplemental tool and upon pressing with a finger on the magazine-clip release button, the magazine-clip will release as normal. As is, the rifle may not meet certain mandated-statute of certain jurisdictions and thus are not allowed.

In another setting, the magazine-clip release will work as a fixed magazine release. That is, the use of additional or supplemental tool is required to depress the magazine-clip release button. Specifically, the magazine is not removable without the use of a tool (a bullet was defined as a tool per state law), which presses a button that a finger alone cannot press. Instead, an additional or supplemental tool such as a button tip will be required to be inserted into the magazine-clip release button in order to release the magazine-clip from the rifle. This configuration is required to meet certain mandated-statute of certain jurisdictions such as California.

Specifically, the double spring system in the magazine-clip release button assembly allows its to be converted from a regular magazine-clip release button to a fixed magazine-clip release button, and vice versa.

In yet another setting, the magazine-clip release will also work to lock out the magazine-clip release button completely. That is, the magazine-clip release button will not be depressed upon a downward pressure on the button. In effect, this will result in the magazine-clip from being released at all from the rifle upon applying pressure on the magazine-clip release button, whether by a finger or through an additional or supplemental tool, such as a bullet tip.

Specifically, this third additional function is possible because of the side locking screw. The side locking screw can be inserted into the magazine-clip release button assembly to lock the button. This will prevent the magazine-clip release button from being pressed down to release the magazine-clip, regardless of whether a finger or additional or supplemental tool was used.

DETAIL DESCRIPTIONS OF THE DRAWINGS

Figure 2:
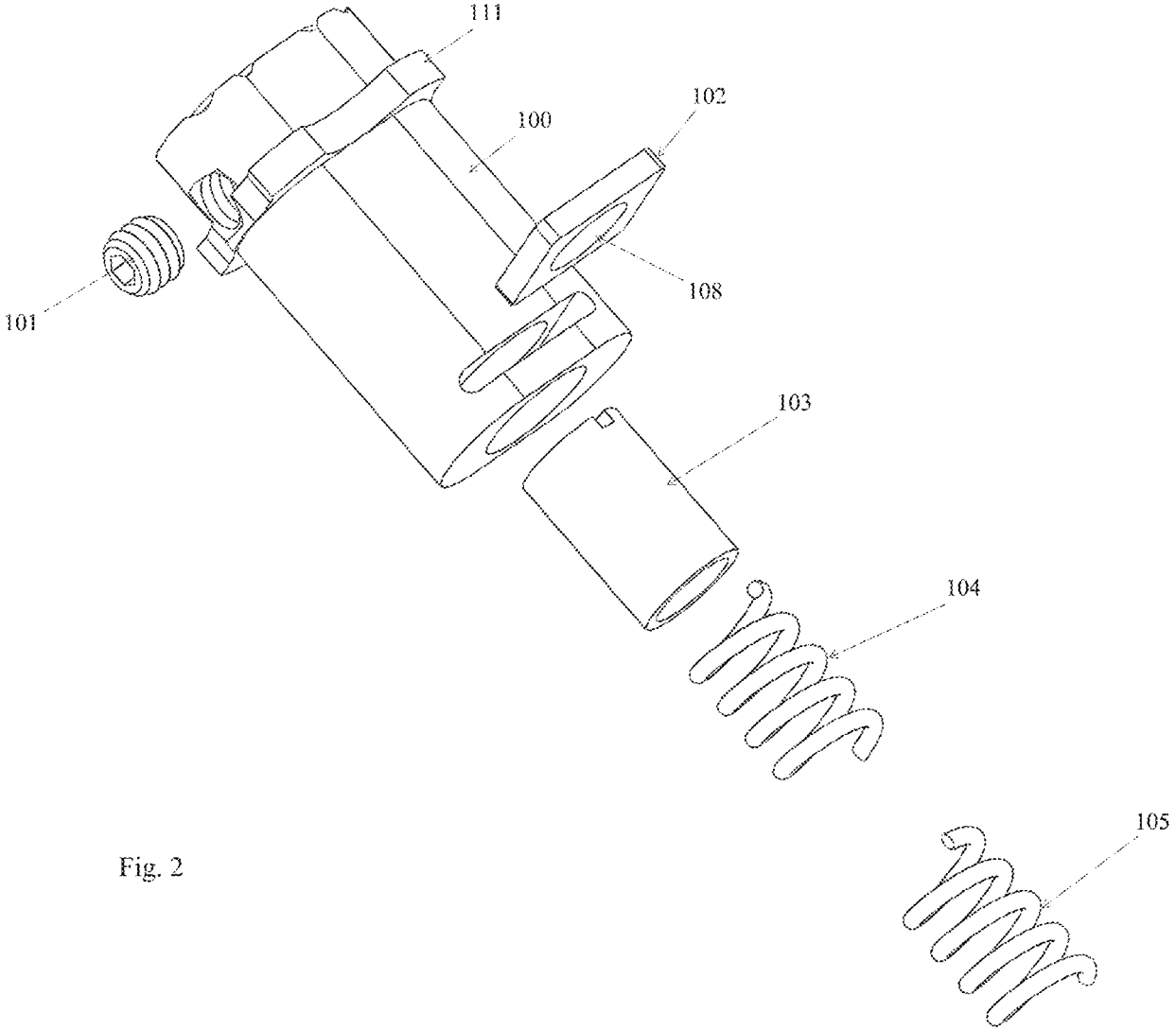
FIG. 2 is another perspective view from a different angle of a disassembled firearm button magazine release tool assembly.
Figure 3:
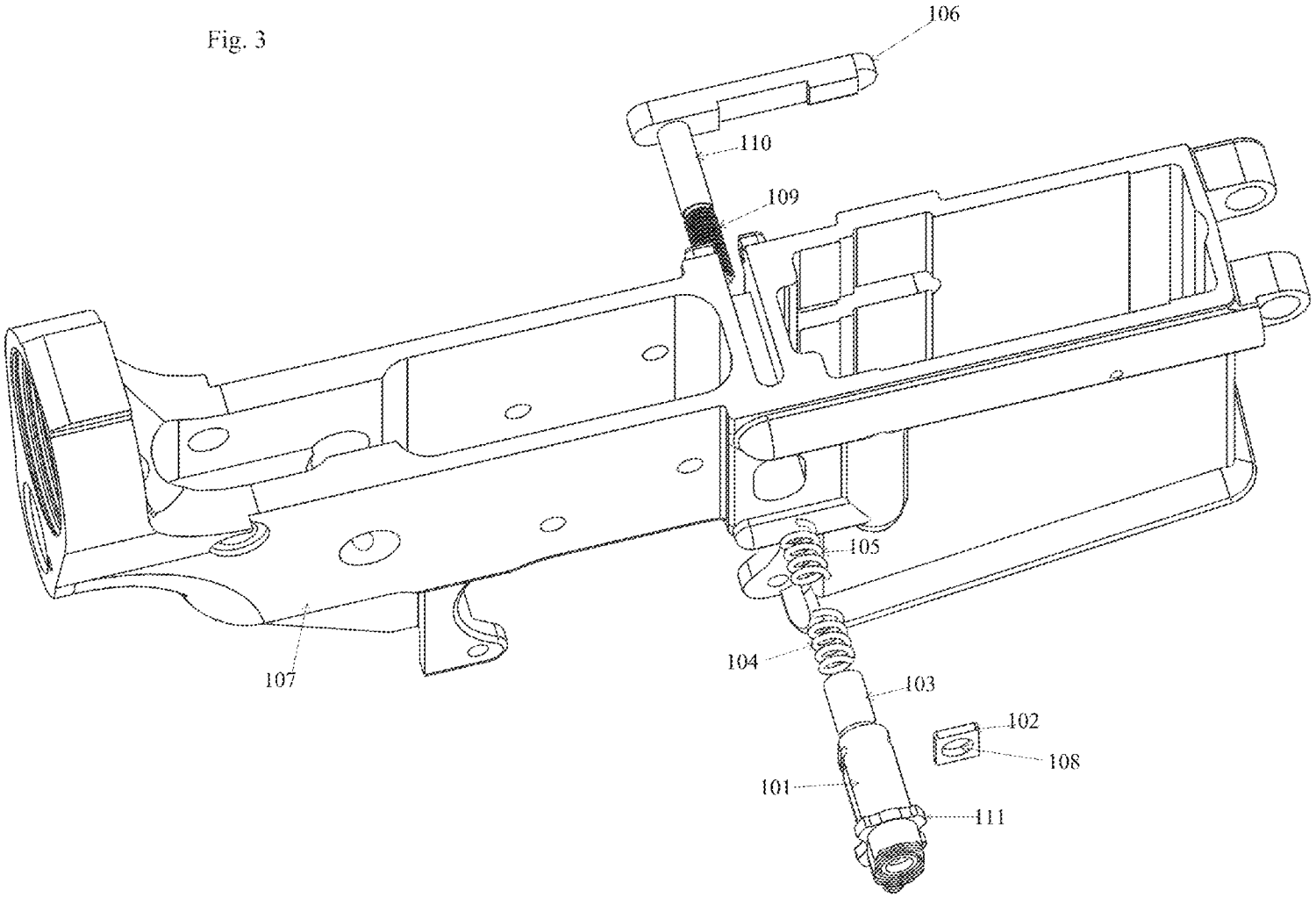
FIG. 3 is a perspective view of a disassembled lowered receiver and firearm button magazine release tool assembly.

Referring to FIGS. 1, 2, and 3, the magazine-clip release-button mechanism tool assembly includes a button barrel 100, a side locking screw 101, a side piece 102, an inner button 103, and a double springs system 104, 105. The double springs (spring A 104, spring B 105) allows the system to function as a regular magazine release or a fixed magazine release, depending on the adjustment of the inner button in relation to the magazine catch thread portion 109. The side-locking screw 101, on the other hand, allows the system to lock out the inner button 103 completely, thus it prevents the magazine from being release at all.

Figure 4:
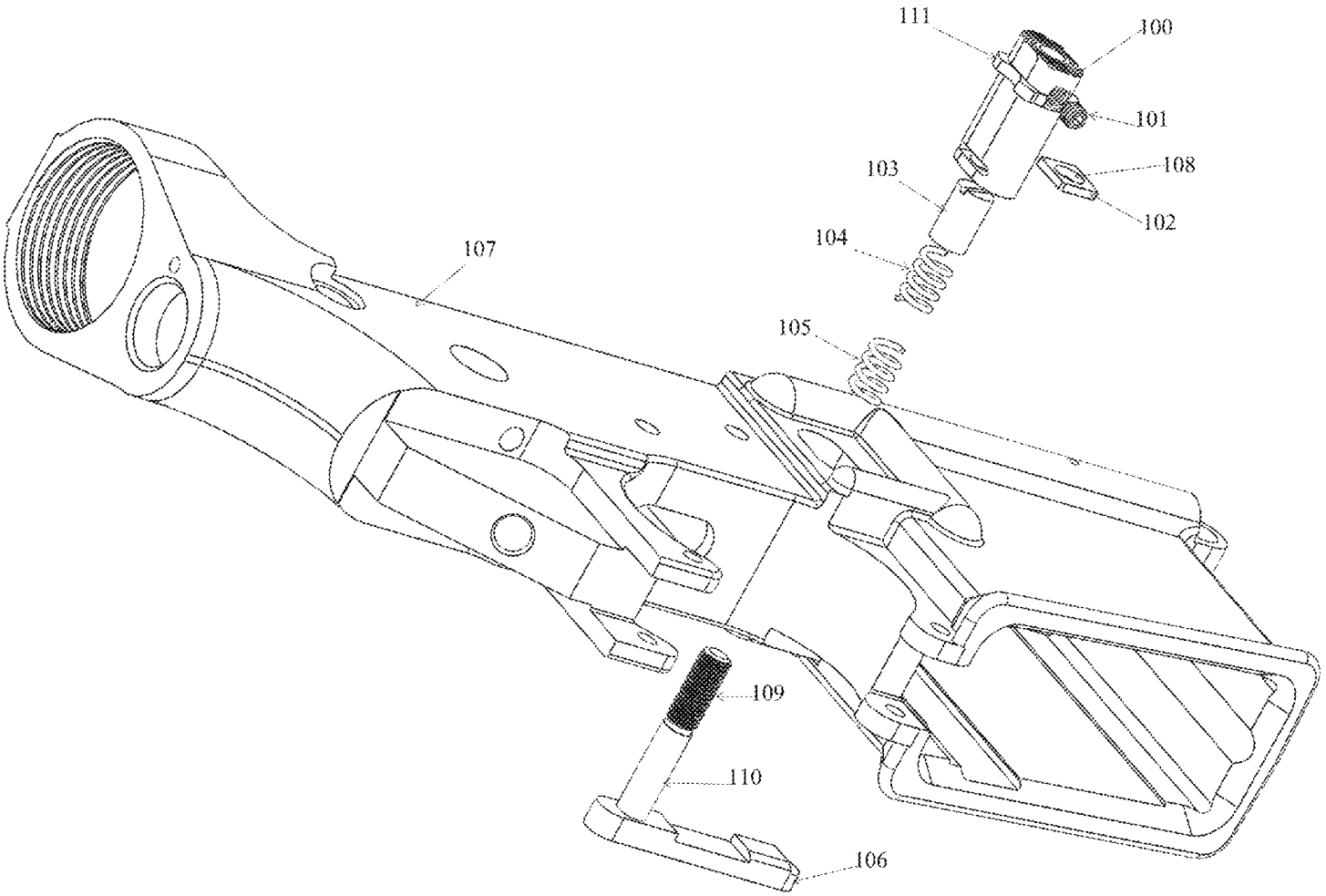
FIG. 4 is another perspective view of a disassembled lowered receiver and firearm button magazine release tool assembly.

Referring to FIGS. 3 and 4, the magazine-clip release-button mechanism tool assembly can be effectively and efficiently installed to modify a firearm quickly without much hassle to replace the standard magazine-clip release-button. The button barrel 100, side locking screw 101, side piece 102, inner button 103 and double springs 104, 105 of the magazine-clip release button tool assembly can be installed in conjunction with the magazine catch 106 to the lower receiver 107 of the firearm. Once installed, the firearm button magazine release tool assembly can work as a regular magazine release, as a fixed magazine release (Bullet Button™), or as a complete lock out the button to prevent release of the magazine.

Specifically, in one embodiment, the button barrel 100 is hollow and an inner button 103 and a spring A 104 is contained inside the button barrel 100 by a sidepiece 102. Sidepiece 102 has a center opening 108 which allows magazine catch threaded portion 109 to be functionally engaged to the inner button 103 through the center opening 108. Specifically, in one embodiment, the magazine catch threaded portion 109 engages the inner button 103 functional in connection to the inner button having counter threaded portion. Similarly, spring B 105 will be located over and through the magazine catch shaft 110 when the apparatus is assembled to the lower receiver 107.

In one embodiment, when the apparatus is functioning as in regular release mode, the magazine release threaded portion 109 is engaged to the inner button 103 such that the button barrel 101 is able to push the magazine catch 106, through the inner button 103, with at least a 2 mm of traveling space. The 2 mm traveling space is all that is needed for the magazine catch 106 to release the ammo magazine. Typically, the inner button is engaged 103 to the threaded portion 109 by using a screw driver to rotate the inner button 103 and by leaving at least a 2 mm of space between the skirt 111 of the button barrel 100 and the receiver 107.

In another embodiment, where the apparatus is aimed to be functioning as fixed magazine release mode, the magazine release screw is engaged to the inner button 3 such that, when assembled to the lower receiver 107, the button barrel 111 is unable to be depressed thus unable cause the magazine catch 106 to move. This is accomplished by rotating the inner button 103 and it the course moving the button barrel 100 until such that the skirt 111 of the button barrel 100 is firmly against the lower receiver 107. When the skirt 111 of the button barrel 100 is firmly against the lower receiver 107, button barrel 100 cannot be depressed. In this mode, the inner button 103 then can be engaged by a tool and be depressed such that the depression shall cause the magazine catch 106 to travel the necessary 2 mm of movement to release the magazine. This is possible because the movement range of the inner button 3 is not limited by the skirts 111 on the button barrel 100.

Finally, when the apparatus is operating in the complete lock out mode, the inner button 103 is secured to the button barrel 100 by the side locking screw 101 such that inner button 103 cannot travel independently against the button barrel 100. In this mode, the magazine latch screw 107 is engaged to the inner button 103 such that the depression of button barrel 100 will be insufficient to cause the movement of the magazine latch 106 by at least 2 mm for the magazine to be released. This is, as similar to the fixed magazine release mode stated above, the depression range of the button barrel is limited by the skirts 111 such that a fully depressed button barrel in this context is unable to cause the magazine latch to move for at least 2 mm in movement.

In one embodiment, spring A 104 and spring B 105 generates equal pressure. In another embodiment, both springs produces at least 9 pounds of pressure per square inch.

Figure 5:
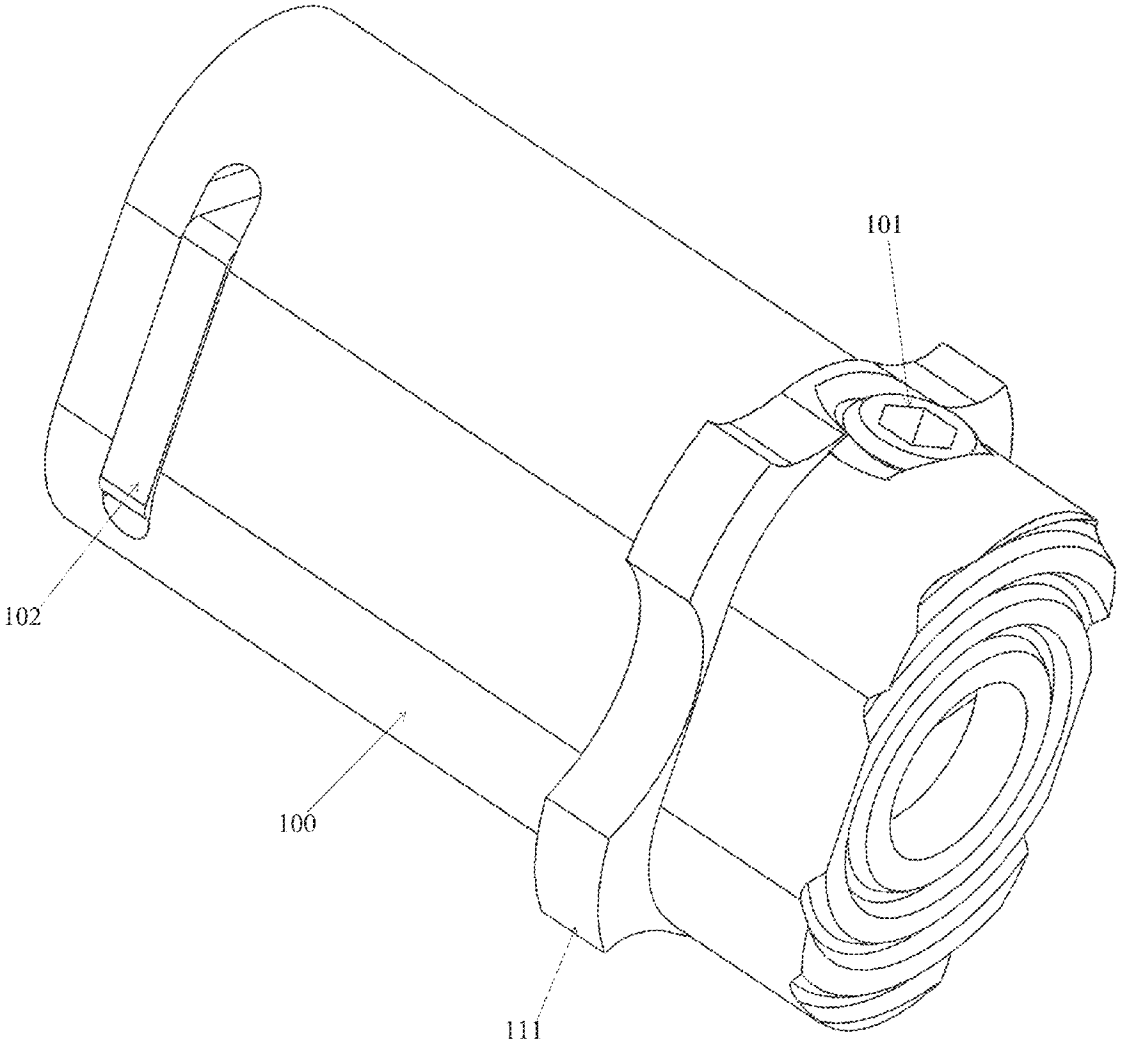
FIG. 5 is a perspective view of an assembled firearm button magazine release tool assembly.
Figure 6:
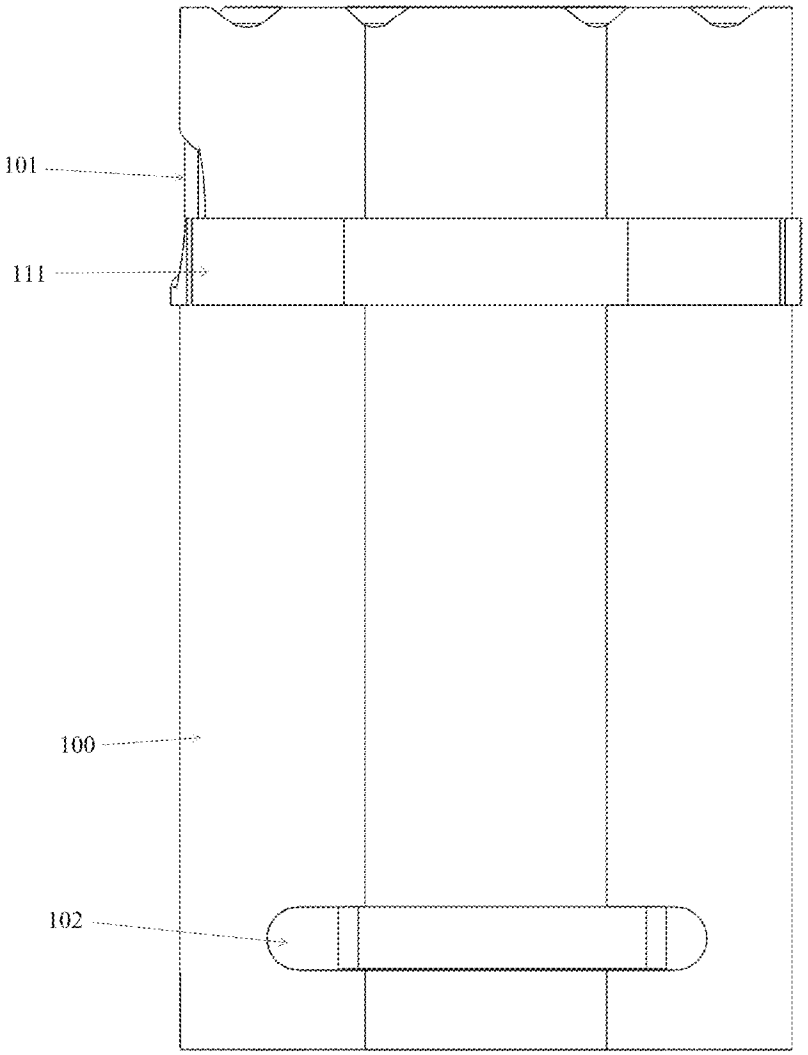
FIG. 6 is the front view of the assembled firearm button magazine release tool assembly.
Figure 7:
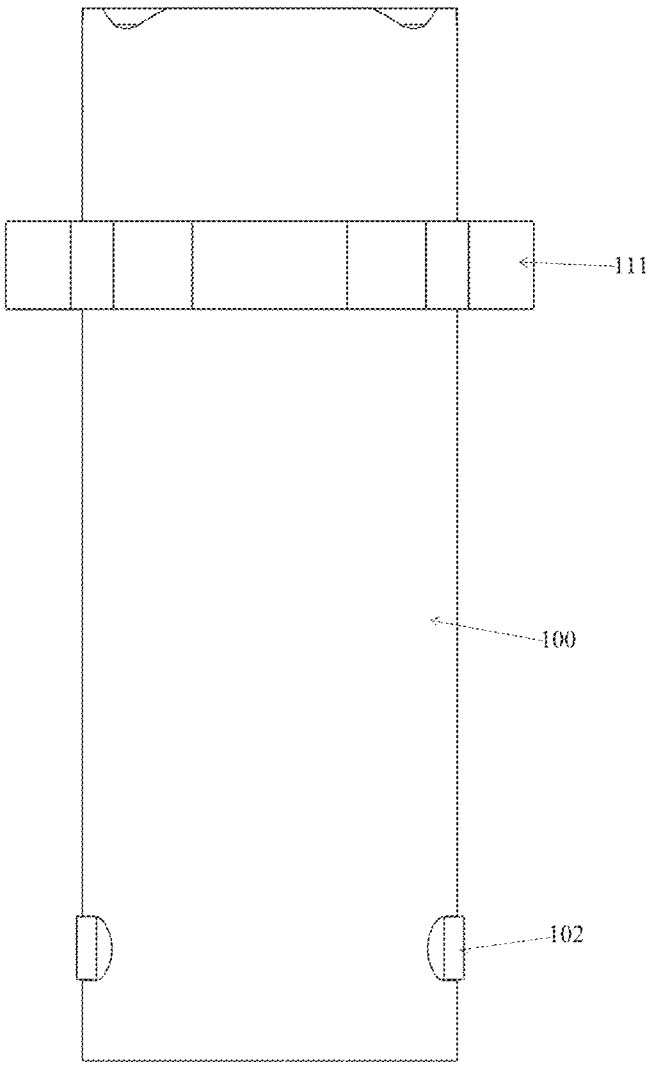
FIG. 7 is the side view of the assembled firearm button magazine release tool assembly.

Referring to FIG. 5, FIG. 6, and FIG. 7, various perspectives of the present invention is depicted showing the button barrel 100, side locking screw 101, side piece 102, and skirts 111.

The invention claimed is:

1. An apparatus for releasing firearm magazine comprising:

a. an outer button, an inner button, a first spring and a securing plate wherein said inner button and said first spring is located within said outer button by said securing plate;

b. a lower receiver of a rifle;

c. a second spring and a magazine catch wherein said magazine catch is comprised of a shaft and a threaded portion wherein said second spring is positioned over said shaft and is further posited inside said lower receiver;

d. said threaded portion is functionally engaged to said inner button such that said inner button can be adjusted along the length of said threaded portion;

e. said outer button further comprising a stopping device along the perimeter of said outer button wherein said stopping device prevents the movement of said outer button towards said lower receiver.

2. The apparatus of claim 1 wherein said stopping device is comprised of one or more tabs.

3. The apparatus of claim 1 wherein said stopping device is comprised of a skirt along the perimeter of said outer button.

4. The apparatus of claim 1 wherein said first spring and said second spring are compression springs.

5. The apparatus of claim 4 wherein said first spring and said second spring have the same spring rate.

6. An apparatus for releasing firearm magazine comprising:

a. an outer button, an inner button, a first spring and a securing plate wherein said inner button and said first spring is located within said outer button by said securing plate;

b. a lower receiver of a rifle;

c. a second spring and a magazine catch wherein said magazine catch is comprised of a shaft and a threaded portion wherein said second spring is positioned over said shaft and is further posited inside said lower receiver;

d. said threaded portion is functionally engaged to said inner button such that said inner button can be adjusted along the length of said threaded portion;

e. said outer button further comprising a stopping device along the perimeter of said outer button wherein said stopping device prevents the movement of said outer button towards said lower receiver f. said outer button further comprises a securing device wherein said securing device functions to secure said inner button to said outer button and to prevent said inner button to move independently against said outer button.

* * * * *